US005655892A

United States Patent [19]

Cherniawski et al.

[11] Patent Number: 5,655,892

[45] Date of Patent: Aug. 12, 1997

[54] THERMALLY ACTUATED FUEL PUMP VAPOR VENT VALVE

[75] Inventors: Richard M. Cherniawski, Caro; Richard L. Kobman, Cass City; George E. Maroney, Kingston, all of Mich.

[73] Assignee: Walbro Corporation, Cass City, Mich.

[21] Appl. No.: 700,308

[22] Filed: Aug. 21, 1996

[51] Int. Cl.[6] ..... F04B 49/22

[52] U.S. Cl. ..... 417/292; 417/435; 137/468

[58] Field of Search ..... 417/292, 366, 417/435; 137/468

[56] References Cited

U.S. PATENT DOCUMENTS

| | | | |
|---|---|---|---|
| 3,186,470 | 6/1965 | Korte | 417/292 |
| 4,569,637 | 2/1986 | Tuckey | 417/435 |
| 5,039,284 | 8/1991 | Talaski | 417/366 |
| 5,263,459 | 11/1993 | Talaski | 417/435 |

FOREIGN PATENT DOCUMENTS

| | | | |
|---|---|---|---|
| 3938 | 1/1977 | Japan | 137/468 |
| 187672 | 11/1983 | Japan | 137/468 |

*Primary Examiner*—Roland McAndrews

*Attorney, Agent, or Firm*—Barnes, Kisselle, Raisch, Choate, Whittemore & Hulbert

[57] ABSTRACT

A thermally actuated vapor vent valve in a fuel pump module allows hot vapor to escape from the fuel pump module when the module is at a temperature significantly above normal operating temperatures. The vent valve is carried by a retainer in the fuel pump module and, at normal operating temperatures, the vent valve is closed on a valve seat of the vapor outlet to prevent vapor flow through the vapor outlet. The valve and the retainer are formed of materials having different coefficients of thermal expansion such that when the fuel pump module becomes heated to a temperature sufficiently above normal operating temperatures the retainer expands and disengages the valve from the valve seat. This allows the hot vapor within the fuel pump module to flow out of the module and thereby prevents the fuel pump from overheating or reaching temperatures which can damage the electric motor that drives the fuel pump.

16 Claims, 1 Drawing Sheet

THERMALLY ACTUATED FUEL PUMP VAPOR VENT VALVE

FIELD OF THE INVENTION

This invention relates to fuel pumps and more particularly, to a vehicle fuel pump having a vapor vent valve.

BACKGROUND OF THE INVENTION

Fuel pumps are used to deliver fuel from a fuel tank to an internal combustion engine of a vehicle. Most fuel pumps are mounted in the fuel tanks of the vehicle and therefore are made to operate over a wide range of ambient temperatures.

Generally, a vehicle fuel pump is driven by an electric motor and they are both mounted inside a housing. The pump is coupled to the armature of the electric motor and draws fuel through an inlet port and discharges the fuel through an outlet port. The pump and electric motor generate heat within the housing and are cooled by the liquid fuel flowing through the pump housing. During use, the vehicle may continue to operate for a period of time even though there is no liquid fuel flow through the fuel pump. For instance, when the fuel tank becomes empty the fuel pump may continue to operate with only fuel vapor in the housing. Without the cooling effect of the liquid fuel flow, the heat generated by the pump and electric motor within the housing can cause the electric motor to overheat and thereby damage or destroy the electric motor.

SUMMARY OF THE INVENTION

A thermally actuated vapor vent valve is provided for a fuel pump module to allow hot vapor to escape from the fuel pump module when the fuel pump module is at a temperature sufficiently above normal operating temperatures. Preferably, the vent valve is carried in a vapor outlet in an end cap of the fuel pump module and, at normal operating temperatures, the vent valve is closed on a valve seat in the vapor outlet to prevent vapor flow through the outlet. The valve is formed of a material having a different coefficient of thermal expansion than the material of the cap surrounding the vapor outlet, and when the fuel pump module reaches a temperature sufficiently above normal operating temperatures the vapor outlet expands disengaging the valve from the valve seat and permitting vapor to flow through the vapor outlet. Allowing the hot vapor to escape helps to prevent the fuel pump from over heating or reaching temperatures which can damage the electric motor of the fuel pump.

Objects, features and advantages of this invention are to provide a vapor vent valve for a fuel pump that is actuated at temperatures above normal operating temperatures to permit vapor to escape from the fuel pump module through a vapor outlet, remains closed when the fuel pump module is at normal operating temperatures, prevents the fuel pump and the fuel pump motor from overheating when there is an insufficient flow of liquid fuel through the fuel pump and the fuel pump motor continues to operate, allows the release of hot vapor from the fuel pump module so that the fuel pump motor is not heated to temperatures which can damage it, automatically closes to prevent flow out of the vapor outlet when the fuel pump module returns to normal operating temperatures, is durable, maintenance free, of relatively simple design and economical manufacture and assembly and has a long in service useful life.

BRIEF DESCRIPTION OF THE DRAWINGS

These and other objects, features and advantages of this invention will be apparent from the following detailed description of the preferred embodiment and best mode, appended claims and accompanying drawings in which:

DETAILED DESCRIPTION OF THE PREFERRED EMBODIMENT

Figure 1:
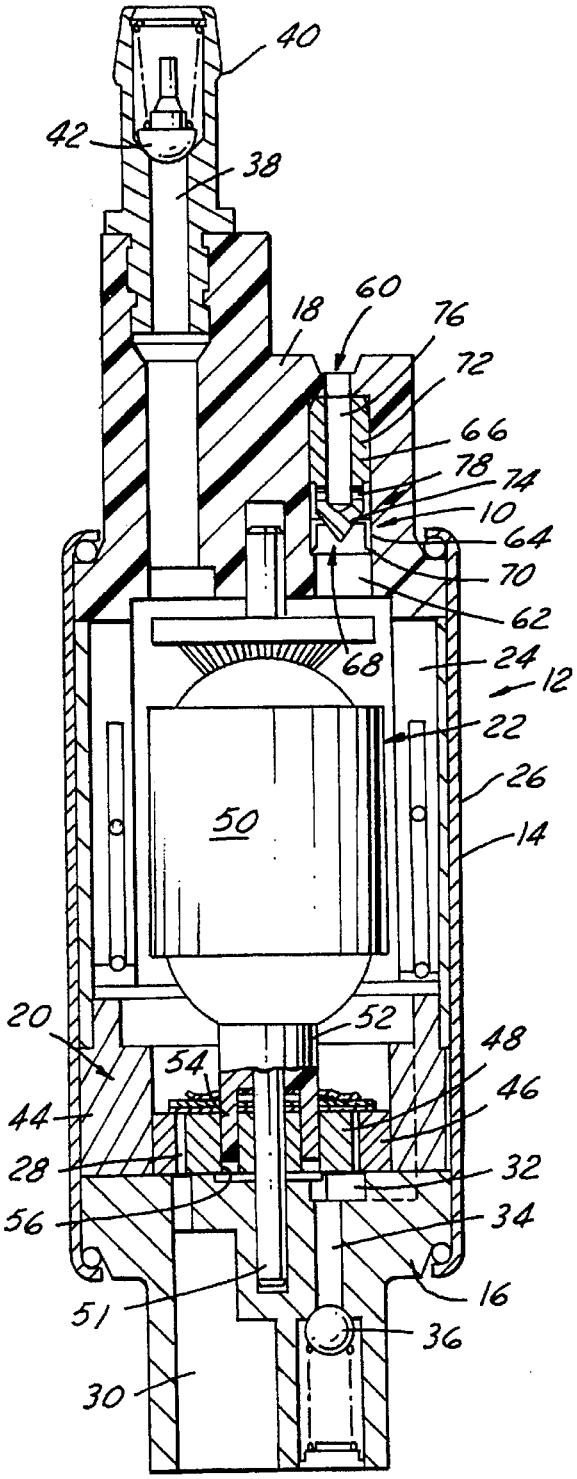
FIG. 1 is a sectional view of a fuel pump module with a vent valve embodying this invention.

As shown in FIG. 1, a thermally actuated vapor vent valve 10 of this invention is disposed within a fuel pump module 12 constructed to be disposed in the fuel tank of a vehicle. The fuel pump module 12 has a housing 14, with an inlet end cap 16 and an outlet end cap 18 received and sealed by O-rings in the opposed ends of a cylindrical outer shell 26. The housing 14 encloses a fuel pump 20 and an electric motor 22 which drives the fuel pump 20 and defines a chamber 24 through which fuel discharged from the pump flows.

The inlet cap 16 is disposed adjacent to a fuel inlet 28 of the fuel pump 20 and has a passage 30 in communication with the bottom of the fuel tank to permit the fuel pump 20 to draw fuel from the bottom of the tank. The inlet cap 16 also has a fuel outlet recess 32 which is in communication with a fuel over pressure relief passage 34 that is normally closed by a check ball valve 36.

The outlet cap 18 is disposed adjacent the outer end of the motor 22 and has an axially extending fuel outlet passage 38 in communication with the chamber 24 and a fuel line connector 40 containing an outlet check valve 42. Fuel is delivered from the fuel pump 20 through the outlet passage 38 through a fuel line to the vehicle engine.

In this particular embodiment the fuel pump 20 is a positive displacement pump with a cam ring 44, an outer gear 46 within the cam ring 44 and an inner gear 48. The electric motor 22 has an armature 50 with a shaft 51 and a drive extension 52 that has circumferentially spaced fingers 54 received in axialholes 56 in the inner gear 48. In normal operation, the pump 20 draws liquid fuel from the fuel tank through the inlet passage 30 and delivers liquid fuel through the outlet passage 38 to the vehicle engine.

A vapor outlet port 60 in the outlet cap 18 of the module 12 communicates with the chamber 24 through a vent passage 62 in which the vent valve is received to control the flow of vapor through the vapor outlet port 60. The valve assembly 10 is thermally actuated and has a valve seat cup 64 and a valve body 66 disposed in the vent passage 62.

Figure 2:
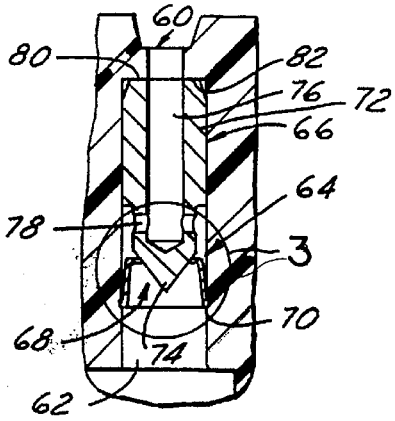
FIG. 2 is a fragmentary sectional view of the vapor outlet and vapor vent valve of this invention.

As shown in FIG. 2, the valve seat cup 64 is preferably a ferrule with an end wall having an opening 68 through which vapor flows when the valve is open with a preferably tapered or frustoconical edge providing a valve seat 69. The end wall merges into a tapered annular side wall with a peripheral radially extending flange 70. To secure the cup 64 in the vent passage 60 and to provide a seal between them the flange is larger in diameter than the passage and is pressed into the passage with an interference fit.

Also as shown in FIG. 2, the valve body 66 is preferably elongate with a generally cylindrical base 72 and a reduced diameter tip with a generally conical head 74 having at least a portion large enough to bear on the seat 69 and completely close the opening 68 of the valve seat cup 64. To allow vapor to flow through the valve body 66 to the exterior of the fuel pump module 12, the valve body 66 is preferably formed with a central blind bore 76 adjacent its base 72, extending towards the head 74 of the conical valve body 66, and communicating with a transverse passage 78 open to the vapor outlet adjacent the conical valve head 74. Thus, when the valve 10 is open vapor can flow through the opening 68 of the seat cup 64, around the valve head 74, through the transverse passage 78 and through the central bore 76 of the valve body 66 and the port 60 to the exterior of the fuel pump module 12.

The valve body 66, may be retained in the passage 62 by the seat cup 64. However, preferably the valve body 66 is also retained and located in the passage 62 with its distal end 80 bearing on the shoulder 82 of the passage 62 by an interference fit of its base 72 with the passage 62. This interference fit tends to prevent movement of the valve body end 80 relative to the passage shoulder 82 due to temperature changes.

Figure 3:
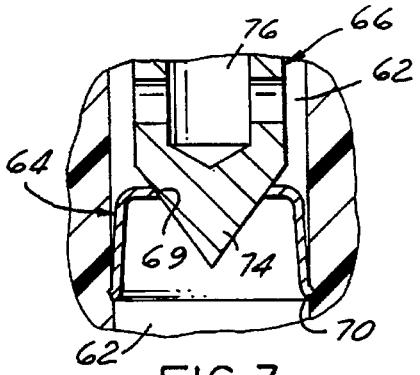
FIG. 3 is an enlarged fragmentary sectional view of the circled portion of FIG. 2.
Figure 4:
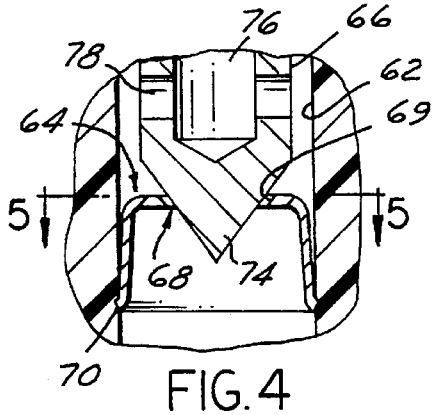
FIG. 4 is an enlarged view of the vent valve in an open position.
Figure 5:
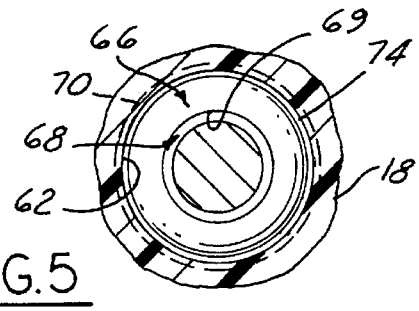
FIG. 5 is a sectional view taken along line 5—5 of FIG. 4.

As shown in FIGS. 2 & 3, at normal operating temperatures, the valve head 74 bears on the seat 69 and completely closes the opening 68 of the valve seat cup 64 to prevent vapor flow through the vapor outlet 60. Upon sufficient heating of the fuel pump module 12 such as when the fuel pump 20 runs dry and there is no liquid fuel flowing through the pump housing to cool the motor 22, the material of the end cap 18 adjacent the vapor passage 62 expands axially increasing the axial length of the vapor passage between its shoulder 82 and the point of engagement of the cup flange 70 with the passage 62 sidewall. In accordance with the present invention, the vapor passage 62 and the valve body 66 are formed of materials having different coefficients of thermal expansion, and in the preferred embodiment, the material forming the vapor passage 62 has a greater coefficient of thermal expansion than the material of the valve body 66. With a greater coefficient of thermal expansion, the vapor passage 62 will expand axially more than the valve body 66 due to a rise in temperature. Thus, because valve body 66 is trapped between the shoulder 82 of the vapor passage and the valve cup 64 therein and has a lower coefficient of thermal expansion than the material forming the vapor passage 62, upon sufficient temperature rise and resultant axial expansion of the vapor passage 62 the valve body 66 is disengaged from the valve seat 69 to open the vapor outlet 68 as shown in FIG. 4.

Preferably, end cap 18 and hence the vapor passage 62 is formed of plastic and, more preferably, of a polyester or an acetyl polymer. A representative coefficient of thermal expansion for polyester is $2.5\times10^{-5}$ cm/cm/°C. and for acetyl is $8.5\times10^{-5}$ cm/cm/°C. The valve body 66 is preferably formed of a metal which has a lower coefficient of thermal expansion than the material of the vapor passage 62, such as steel (approximately $1.13\times10^{-5}$ cm/cm/°C.). The valve seat cup 64 is preferably formed of a metal such as steel to also have a lower coefficient of thermal expansion than the material of the vapor passage 62. Thus, when the temperature increases substantially above normal operating temperatures, the material of the vapor passage 62 expands sufficiently so that the valve head 74 disengages from the valve seat 69 to open the vapor passage 62 and permit vapor to escape through the outlet port 60 to the exterior of the fuel pump module 12.

In use, when the electric fuel pump 20 runs dry such that there is no liquid fuel running through the fuel pump 20 to cool the fuel pump 20, a significant amount of heat is generated by the electric motor 22 of the fuel pump 20. This heat is transferred to the air and fuel vapors in the fuel pump module 12, and the module itself. When the end cap 18 or the module 12 becomes sufficiently heated such that the material adjacent the vapor passage 62 expands sufficiently to open the valve assembly 10, the air and vapor within the fuel chamber are allowed to escape through the vapor outlet 60 to the exterior of the fuel pump module 12. When the valve assembly 10 is open the pump will force cooler air and fuel vapor from the tank through the module to cool it. This prevents the vapor from becoming continually heated and thus unduly increasing the temperature of the fuel pump module 12. Allowing the heated vapor to escape from the fuel pump module 12 prevents the electric motor 22 from reaching temperatures which can damage it.

When fuel is again introduced into the fuel pump 20, and the fuel pump module 12 gradually returns to normal operating temperatures, the material of the end cap 18 adjacent the vapor passage 62 contracts sufficiently to thereby engage the valve head 74 with the valve seat 69 to close the vapor passage 62 and prevent flow therethrough. If the fuel pump runs dry again, and a sufficient temperature is reached within the fuel pump module 12, the vapor passage 62 will again expand and disengage the valve head 74 from the valve seat 69 to allow vapor to flow through the vapor passage 62 and prevent the fuel pump motor 22 from unduly overheating. Thus, the thermally actuated valve 10 can be repeatedly closed and opened to allow vapor to escape from the fuel pump module 12 and thereby prevent the fuel pump motor 22 from being damaged by overheating.

In one practical embodiment of a fuel pump module 12 with a valve assembly 10 having an outlet end cap 18 of acetyl plastic and a valve body 66 and seat cup 64 both of steel when operated for 15 minutes, under dry run conditions without any liquid fuel supplied to the pump inlet 30, the temperature of the exterior surface of the outer shell rose from 23.6° C. to 77.7° C. over a period of seven minutes. With this temperature increase the valve assembly 10 opened and in the remaining 8 minute period the temperature rose to only 88° C. and was relatively stable.

In another fuel pump module 12 which was of the same construction, arrangement and materials except that the outlet end cap was made of polyester plastic, when operated for 15 minutes under the same dry run conditions, the temperature of the exterior surface of the outer shell rose from 20.4° C. to 110.0° C. over a period of 8 minutes. With this temperature increase the valve assembly 10 opened and in the remaining 7 minute period the temperature further rose to 138.0° C.

The superior performance of the pump module with the acetyl plastic end cap is believed to be due to the greater coefficient of expansion of acetyl compared to polyester plastic which results in a greater opening of the valve assembly 10 and hence a greater flow rate of air and vapors through the pump module which cools it to a significantly lower dry run temperature.

In contrast in fuel pump modules 12 of the same construction and arrangement but without any vapor relief port or valve, when operated under the same dry run conditions, fail due to overheating of the electric motor with an outer exterior surface of the outer shell reaching a temperature of 170° C. in a period of about eight (8) minutes. It is necessary to limit the maximum exterior shell temperature to about 150° C. and preferably 140° C. to avoid damaging the electric motor.

We claim:

1. A fuel pump module comprising:

a fuel pump having an inlet and an outlet;

an electric motor operably connected to the fuel pump;

a housing having an interior enclosing the electric motor and the fuel pump, said pump outlet communicating with the interior of the housing;

a fuel inlet, carried by the housing and constructed to supply liquid fuel from the exterior of the housing to the pump inlet;

a fuel outlet carried by the housing and constructed to supply liquid fuel from the pump to the exterior of the housing;

a vapor outlet carried by the housing and communicating the interior of the housing with the exterior of the housing;

a retainer forming a valve passage communicating with said vapor outlet;

a valve seat disposed within the valve passage; and a valve body having a pair of generally opposed ends and associated with the valve seat and the retainer so that at a first temperature of the pump module the valve body adjacent one end bears on the valve seat to close the vapor outlet and the valve body adjacent its other end bears on the retainer and the retainer and the valve body are of materials having different coefficients of thermal expansion such that at a second temperature significantly above the first temperature of the pump module the valve body disengages from the valve seat to open the vapor outlet.

2. The fuel pump module of claim 1 wherein the valve body has a head at one end and a base at its opposite end and the base bears on the retainer defining the valve passage.

3. The fuel pump module of claim 1 wherein the second temperature is less than about 150° Centigrade.

4. The fuel pump module of claim 1 wherein the valve body is formed of a material having a smaller coefficient of thermal expansion than the material of the retainer forming the valve passage.

5. The fuel pump module of claim 4 wherein the retainer forming the valve passage comprises an outlet end cap of a plastic and is carried by the housing.

6. The fuel pump module of claim 1 wherein the valve seat is formed of a material having a smaller coefficient of thermal expansion than the retainer forming the valve passage.

7. The fuel pump module of claim 6 wherein the valve seat is of metal and the body forming the valve passage is of plastic.

8. The fuel pump module of claim 6 wherein the valve body is formed of a material having a smaller coefficient of thermal expansion than that of the material of the retainer forming the valve passage.

9. The fuel pump module of claim 8 wherein the valve body is of metal and the retainer forming the valve passage is of plastic.

10. The fuel pump of claim 9 wherein the valve body is of steel and the retainer forming the valve passage is of an acetal polymer.

11. The fuel pump module of claim 9 wherein the valve body is of steel and the retainer forming the valve passage is of a polyester polymer.

12. The fuel pump module of claim 1 wherein the valve seat is a generally annular disk, with an opening therethrough, and is carried by the retainer forming the valve passage.

13. The fuel pump module of claim 12 wherein the valve body is elongate and has a head adjacent the valve seat that is generally conical and is partially located in the opening through the disk and with at least a portion larger than the opening and capable of completely closing the opening.

14. The fuel pump module of claim 13 wherein the valve body has a transverse passage formed adjacent its head and an axial bore passage formed adjacent the end of the valve body opposite the head and communicating with the transverse passage to permit gaseous flow through the valve body when the valve is open.

15. The fuel pump module of claim 12 wherein the valve seat is carried by the valve passage.

16. The fuel pump module of claim 15 wherein the valve seat has an annular flange larger in diameter than the the valve passage and is constructed to provide an interference fit between the valve seat and the valve passage when the valve seat is press-fit into the valve passage.

* * * * *

UNITED STATES PATENT AND TRADEMARK OFFICE

CERTIFICATE OF CORRECTION

PATENT NO. : 5,655,892

DATED : August 12, 1997

INVENTOR(S) : Richard M. Cherniawski, Richard L. Kobman, George E. Maroney

It is certified that error appears in the above-indentified patent and that said Letters Patent is hereby corrected as shown below:

Col 6, Line 8, change "claim 6" to "claim 13".

Signed and Sealed this

Ninth Day of December, 1997

*Attest:*

*Attesting Officer*

BRUCE LEHMAN

*Commissioner of Patents and Trademarks*